US008105131B2

(12) United States Patent
Kistler et al.

(10) Patent No.: US 8,105,131 B2
(45) Date of Patent: Jan. 31, 2012

(54) METHOD AND APPARATUS FOR REMOVING MATERIAL FROM MICROFEATURE WORKPIECES

(75) Inventors: Rodney C. Kistler, Eagle, ID (US); Andrew Carswell, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 254 days.

(21) Appl. No.: 12/621,366

(22) Filed: Nov. 18, 2009

(65) Prior Publication Data

US 2010/0059705 A1 Mar. 11, 2010

Related U.S. Application Data

(60) Continuation of application No. 11/938,097, filed on Nov. 9, 2007, now Pat. No. 7,628,680, which is a division of application No. 11/218,239, filed on Sep. 1, 2005, now Pat. No. 7,294,049.

(51) Int. Cl.
*B24B 1/00* (2006.01)

(52) U.S. Cl. ..... 451/56; 51/300; 51/307

(58) Field of Classification Search ..... 451/56; 51/300

See application file for complete search history.

(56) References Cited

U.S. PATENT DOCUMENTS 3,450,738 A 6/1969 Blochl
5,020,283 A 6/1991 Tuttle
5,081,796 A 1/1992 Schultz
5,177,908 A 1/1993 Tuttle
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,297,364 A 3/1994 Tuttle
5,421,769 A 6/1995 Schultz et al.
5,433,651 A 7/1995 Lustig et al.
5,449,314 A 9/1995 Meikle et al.
5,486,129 A 1/1996 Sandhu et al.
5,514,245 A 5/1996 Doan et al.
5,533,924 A 7/1996 Stroupe et al.
5,540,810 A 7/1996 Sandhu et al.
5,618,381 A 4/1997 Doan et al.
5,624,303 A 4/1997 Robinson
5,643,060 A 7/1997 Sandhu et al.
5,650,619 A 7/1997 Hudson
5,658,183 A 8/1997 Sandhu et al.
5,658,190 A 8/1997 Wright et al.
5,664,988 A 9/1997 Stroupe et al.
5,679,065 A 10/1997 Henderson
5,690,540 A 11/1997 Elliott et al.
5,698,455 A 12/1997 Meikle et al.
5,702,292 A 12/1997 Brunelli et al.
5,730,642 A 3/1998 Sandhu et al.
5,733,176 A 3/1998 Robinson et al.
5,736,427 A 4/1998 Henderson
5,738,567 A 4/1998 Manzonie et al.
5,747,386 A 5/1998 Moore (Continued)

OTHER PUBLICATIONS

Kondo, S. et al., "Abrasive-Free Polishing for Copper Damascene Interconnection," Journal of the Electrochemical Society, vol. 147, No. 10, pp. 3907-3913, 2000.

*Primary Examiner* — Maurina Rachuba
(74) *Attorney, Agent, or Firm* — Perkins Coie LLP

(57) ABSTRACT

Methods and apparatus for removing materials from microfeature workpieces. One embodiment of a subpad in accordance with the invention comprises a matrix having a first surface configured to support a polishing medium and a second surface opposite the first surface. The subpad in this embodiment further includes a hydro-control agent in the matrix. The hydro-control agent has a hydrophobicity that inhibits liquid from absorbing into the subpad. The hydro-control agent, for example, can be coupling agents that are generally hydrophobic, surfactants that are hydrophobic, or other agents that are compatible with the matrix and at least generally hydrophobic.

20 Claims, 2 Drawing Sheets

U.S. PATENT DOCUMENTS 5,792,709 A 8/1998 Robinson et al.
5,795,218 A 8/1998 Doan et al.
5,795,495 A 8/1998 Meikle
5,807,165 A 9/1998 Uzoh et al.
5,823,855 A 10/1998 Robinson
5,825,028 A 10/1998 Hudson
5,830,806 A 11/1998 Hudson et al.
5,851,135 A 12/1998 Sandhu et al.
5,868,896 A 2/1999 Robinson et al.
5,871,392 A 2/1999 Meikle et al.
5,879,222 A 3/1999 Robinson
5,882,248 A 3/1999 Wright et al.
5,893,754 A 4/1999 Robinson et al.
5,895,550 A 4/1999 Andreas
5,910,043 A 6/1999 Manzonie et al.
5,919,082 A 7/1999 Walker et al.
5,934,980 A 8/1999 Koos et al.
5,938,801 A 8/1999 Robinson
5,945,347 A 8/1999 Wright
5,954,912 A 9/1999 Moore
5,967,030 A 10/1999 Blalock
5,972,792 A 10/1999 Hudson
5,976,000 A 11/1999 Hudson
5,980,363 A 11/1999 Meikle et al.
5,981,396 A 11/1999 Robinson et al.
5,989,470 A 11/1999 Doan et al.
5,990,012 A 11/1999 Robinson et al.
5,994,224 A 11/1999 Sandhu et al.
5,997,384 A 12/1999 Blalock
6,036,586 A 3/2000 Ward
6,039,633 A 3/2000 Chopra
6,040,245 A 3/2000 Sandhu et al.
6,054,015 A 4/2000 Brunelli et al.
6,062,958 A 5/2000 Wright et al.
6,066,030 A 5/2000 Uzoh
6,074,286 A 6/2000 Ball
6,083,085 A 7/2000 Lankford
6,090,475 A 7/2000 Robinson et al.
6,110,820 A 8/2000 Sandhu et al.
6,114,706 A 9/2000 Meikle et al.
6,116,988 A 9/2000 Ball
6,120,354 A 9/2000 Koos et al.
6,125,255 A 9/2000 Litman
6,135,856 A 10/2000 Tjaden et al.
6,136,043 A 10/2000 Robinson et al.
6,139,402 A 10/2000 Moore
6,143,123 A 11/2000 Robinson et al.
6,143,155 A 11/2000 Adams et al.
6,152,808 A 11/2000 Moore
6,176,763 B1 1/2001 Kramer et al.
6,176,992 B1 1/2001 Talieh
6,186,870 B1 2/2001 Wright et al.
6,187,681 B1 2/2001 Moore
6,191,037 B1 2/2001 Robinson et al.
6,193,588 B1 2/2001 Carlson et al.
6,196,899 B1 3/2001 Chopra et al.
6,200,901 B1 3/2001 Hudson et al.
6,203,404 B1 3/2001 Joslyn et al.
6,203,407 B1 3/2001 Robinson
6,203,413 B1 3/2001 Skrovan
6,206,754 B1 3/2001 Moore
6,206,756 B1 3/2001 Chopra et al.
6,206,759 B1 3/2001 Agarwal et al.
6,210,257 B1 4/2001 Carlson
6,213,845 B1 4/2001 Elledge
6,218,316 B1 4/2001 Marsh
6,220,934 B1 4/2001 Sharples et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,238,273 B1 5/2001 Southwick
6,244,944 B1 6/2001 Elledge
6,250,994 B1 6/2001 Chopra et al.
6,251,785 B1 6/2001 Wright
6,254,460 B1 7/2001 Walker et al.
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,273,800 B1 8/2001 Walker et al.
6,276,996 B1 8/2001 Chopra
6,277,015 B1 8/2001 Robinson et al.
6,290,579 B1 9/2001 Walker et al.
6,296,557 B1 10/2001 Walker
6,306,012 B1 10/2001 Sabde
6,306,014 B1 10/2001 Walker et al.
6,306,768 B1 10/2001 Klein
6,309,282 B1 10/2001 Wright et al.
6,312,558 B2 11/2001 Moore
6,313,038 B1 11/2001 Chopra et al.
6,325,702 B2 12/2001 Robinson
6,328,632 B1 12/2001 Chopra
6,331,135 B1 12/2001 Sabde et al.
6,331,139 B2 12/2001 Walker et al.
6,331,488 B1 12/2001 Doan et al.
6,350,180 B2 2/2002 Southwick
6,350,691 B1 2/2002 Lankford
6,352,466 B1 3/2002 Moore
6,354,919 B2 3/2002 Chopra
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,400 B2 3/2002 Southwick
6,361,417 B2 3/2002 Walker et al.
6,361,832 B1 3/2002 Agarwal et al.
6,364,749 B1 4/2002 Walker
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde
6,383,934 B1 5/2002 Sabde et al.
6,387,289 B1 5/2002 Wright
6,395,620 B1 5/2002 Pan et al.
6,402,884 B1 6/2002 Robinson et al.
6,409,586 B2 6/2002 Walker et al.
6,428,386 B1 8/2002 Bartlett
6,428,586 B1 8/2002 Yancey
6,447,369 B1 9/2002 Moore
6,454,634 B1 9/2002 James et al.
6,498,101 B1 12/2002 Wang
6,511,576 B2 1/2003 Klein
6,520,834 B1 2/2003 Marshall
6,533,893 B2 3/2003 Sabde et al.
6,547,640 B2 4/2003 Hofmann
6,548,407 B1 4/2003 Chopra et al.
6,579,799 B2 6/2003 Chopra et al.
6,582,283 B2 6/2003 James et al.
6,582,623 B1 6/2003 Grumbine et al.
6,592,443 B1 7/2003 Kramer et al.
6,609,947 B1 8/2003 Moore
6,620,036 B2 9/2003 Freeman et al.
6,623,329 B1 9/2003 Moore
6,646,348 B1 11/2003 Grumbine et al.
6,652,764 B1 11/2003 Blalock
6,666,749 B2 12/2003 Taylor
6,913,517 B2 7/2005 Prasad
7,294,049 B2 11/2007 Kistler et al.
2005/0032464 A1* 2/2005 Swisher et al. ..... 451/41
2005/0036918 A1 2/2005 Lange et al.
2006/0089094 A1* 4/2006 Swisher et al. ..... 451/527
2008/0064306 A1 3/2008 Kistler et al.

* cited by examiner

METHOD AND APPARATUS FOR REMOVING MATERIAL FROM MICROFEATURE WORKPIECES

CROSS-REFERENCE TO RELATED APPLICATIONS

This application is a continuation of U.S. application Ser. No. 11/938,097, filed Nov. 9, 2007 now U.S. Pat. No. 7,628,680, which is a divisional of U.S. application Ser. No. 11/218,239, filed Sep. 1, 2005, now U.S. Pat. No. 7,294,049, both of which are incorporated herein by reference in their entirety.

TECHNICAL FIELD

The present invention is directed toward methods and apparatus for removing material from microfeature workpieces in the manufacturing of microelectronic devices, micromechanical devices, and/or microbiological devices. Several embodiments of methods and apparatus in accordance with the invention are directed toward subpads and pad assemblies for mechanically removing material from microfeature workpieces.

BACKGROUND

One class of processes for removing materials from microfeature workpieces uses abrasive particles to abrade the workpieces either with or without a liquid solution. For example, mechanical and chemical-mechanical processes (collectively "CMP") remove material from microfeature workpieces in the production of microelectronic devices and other products. FIG. 1 schematically illustrates a rotary CMP machine 10 with a platen 20, a head 30, and a planarizing pad 40. The CMP machine 10 may also have a conventional subpad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the subpad 25, the planarizing pad 40 moves with the platen 20 during planarization.

The head 30 has a lower surface 32 to which a microfeature workpiece 12 may be attached, or the workpiece 12 may be attached to a resilient pad 34 in the head 30. The head 30 may be a weighted, free-floating wafer carrier, or the head 30 may be attached to an actuator assembly 36 (shown schematically) to impart rotational motion to the workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the workpiece 12. The planarizing solution 44 may be a conventional CMP slurry with abrasive particles and chemicals that etch and/or oxidize the surface of the microfeature workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the microfeature workpiece 12 with the CMP machine 10, the head 30 presses the workpiece 12 face-down against the planarizing pad 40. More specifically, the head 30 generally presses the microfeature workpiece 12 against a planarizing surface 42 of the planarizing pad 40 in the presence of the planarizing solution 44, and the platen 20 and/or the head 30 moves to rub the workpiece 12 against the planarizing surface 42.

One challenge of CMP processing is to consistently produce uniformly planar surfaces on a large number of workpieces in a short period of time. Several variables influence the performance of CMP processes, and it is important to control the variables to uniformly remove material from microfeature workpieces. The mechanical and geometric properties of the subpad 25 and the planarizing pad 40 are variables that can affect the uniformity of the planarized surfaces and the polishing rate of the process. For example, grooves or other features on the planarizing pad 40 will affect the distribution of planarizing solution under the workpieces, and the hardness of the planarizing pad 40 will affect the polishing rate and the local conformity of the planarizing surface 42 to the contour of the workpiece 12. Similarly, the hardness and elasticity of the subpad 25 will affect the global compliance of the polishing pad 40 to the workpiece. As such, it is desirable to control the properties of the subpad 25 and the polishing pad 40.

One type of existing subpad, called a filled subpad, has a polymeric matrix and a filler material in the matrix. The filler material can be polymer spheres, or the filler material can be silica particles, alumina particles, other metal oxide particles, or other inorganic particles that fill spaces within the polymeric matrix. The filler materials are generally used to reduce the manufacturing cost. Conventional subpads often have a polymeric matrix without a filler material. Conventional subpads and existing subpads, however, may not perform well for sufficient periods of time.

One drawback of conventional unfilled subpads and existing filled subpads is that their mechanical properties may change over time and lead to a degradation of performance. For example, the polymeric matrix of most subpads will absorb water and other liquids used in the planarizing solutions. The mechanical properties of the subpads will accordingly change depending upon the extent of liquid absorption. This not only degrades the performance of the CMP process and leads to non-uniformities on the planarized surfaces, but it also shortens the pad life and increases the operating costs of CMP equipment.

Another drawback of subpads with filler materials is that the subpads may not have the optimal mechanical properties. More specifically, many desirable filler materials may not be suitably compatible with the polymeric matrix materials. The lack of compatibility between filler materials and polymeric materials can limit the mechanical properties of the subpads. As a result, subpads with filler materials may not perform at optimal levels. Therefore, it would be desirable to enhance the performance of subpads with filler materials.

DETAILED DESCRIPTION

A. Overview

Figure 1:
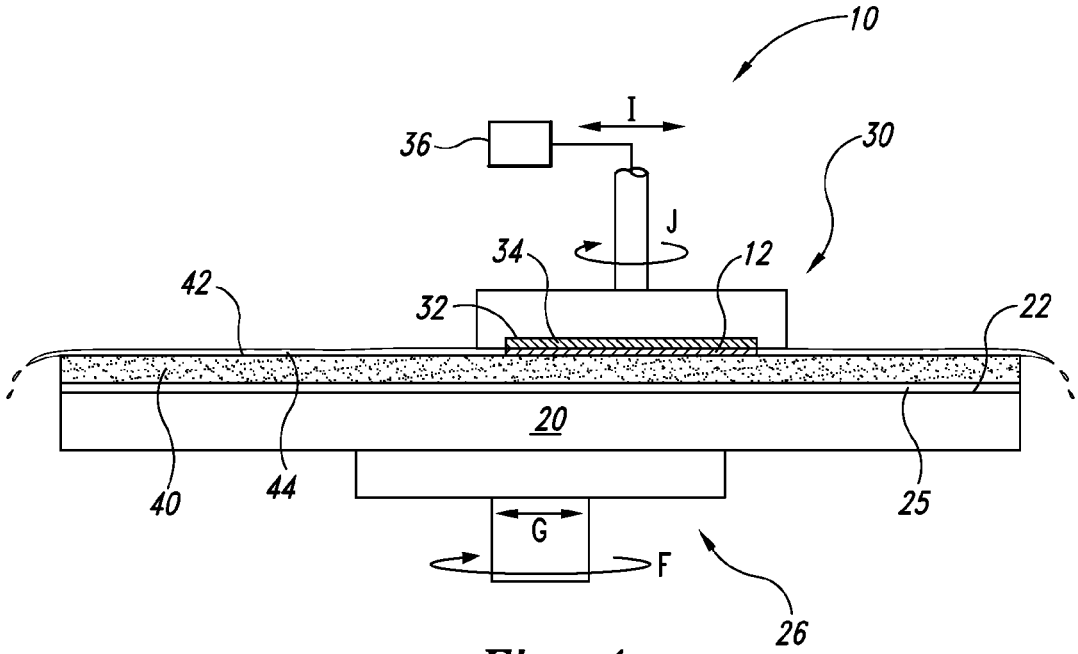
Fig. 1 (Prior Art)
FIG. 1 is a schematic side elevation view of a CMP machine in accordance with the prior art.

The present invention is directed toward methods and apparatus for mechanically and/or chemically-mechanically removing material from microfeature workpieces. Several embodiments of the invention are directed toward subpads that inhibit or otherwise prevent absorption of liquid. Certain subpads in accordance with the invention are at least generally impermeable to the liquids used in the processing solutions. As a result, several embodiments of subpads in accordance with the invention are expected to provide consistent mechanical properties to uniformly planarize the surface of a workpiece and to increase the life of the pad assembly.

One aspect of the invention is directed toward subpads for use in removing material from a microfeature workpiece. An embodiment of such a subpad in accordance with the invention comprises a matrix having a first surface configured to support a polishing medium and a second surface opposite the first surface. The subpad in this embodiment further includes a hydro-control agent in the matrix. The hydro-control agent has a hydrophobicity that inhibits liquid from absorbing into the subpad. The hydro-control agent, for example, can be coupling agents that are generally hydrophobic, surfactants that are hydrophobic, or other agents that are compatible with the matrix and at least generally hydrophobic.

Another embodiment of a subpad in accordance with the invention comprises a polymeric medium having a first surface configured to support a polishing pad and a second surface opposite the first surface. The subpad can further include an inorganic filler material in the polymeric medium, and a hydro-agent attached to the inorganic filler material. The hydro-agent in this embodiment reduces the permeability of the polymeric medium to liquids.

Still another embodiment of a subpad in accordance with the invention comprises a polymeric material having a first surface configured to support a polishing pad and a second surface opposite the first surface. This subpad can further include an inorganic filler material in the polymeric material and a silane coupling agent attached to the inorganic filler material and/or the polymeric material.

Another aspect of the invention is directed toward pad assemblies for use in removing material from microfeature workpieces. An embodiment of one such pad assembly comprises a planarizing medium having a bearing surface configured to contact a workpiece and a backside. The pad assembly can further include a subpad in contact with the backside of the planarizing medium. The subpad comprises a matrix and a hydro-control agent in the matrix, and the hydro-control agent has a hydrophobicity that inhibits liquid from absorbing into the subpad.

Another embodiment of a pad assembly in accordance with the invention comprises a planarizing medium having a bearing surface configured to contact the workpiece and a backside. This pad assembly also includes a subpad in contact with the backside of the planarizing medium. The subpad comprises a polymeric medium, an inorganic filler material in the polymeric medium, and a hydro-agent attached to the inorganic filler material and/or the polymeric medium. The hydro-agent reduces the permeability of the polymeric medium to liquid.

Still another embodiment of a pad assembly in accordance with the invention comprises a planarizing medium having a bearing surface configured to contact the workpiece and a backside, and a subpad in contact with the backside of the planarizing medium. The subpad in this embodiment comprises a polymeric medium, an inorganic filler material in the polymeric medium, and a silane coupling agent attached to the inorganic filler material and/or the polymeric medium.

Another aspect of the invention is directed toward an apparatus for removing material from the microfeature workpiece. An embodiment of one such apparatus includes a support, a pad assembly on the support, and a workpiece holder configured to hold a workpiece relative to the pad assembly. The pad assembly includes a planarizing medium and a subpad having a matrix and a hydro-control agent in the matrix. The hydro-control agent, for example, has a hydrophobicity that inhibits liquid from absorbing into the subpad. In several embodiments, the workpiece holder and/or the support move to rub the workpiece against the bearing surface of the planarizing medium.

Another aspect of the invention is directed toward a method for removing material from a microfeature workpiece. One embodiment of such a method includes rubbing the workpiece against a pad assembly having a planarizing medium and a subpad under the planarizing medium. This method further includes repelling liquid from the subpad to inhibit liquid from absorbing into the subpad.

Another aspect of the invention is directed toward manufacturing subpads for use in removing material from a microfeature workpiece. One embodiment of such a method comprises attaching a hydro-control agent to an inorganic filler material to increase the hydrophobicity of the inorganic filler material. This method further includes mixing a matrix material with the inorganic filler material having the attached hydro-control agent to form a pad mixture, and forming the pad mixture into a subpad.

Figure 2:
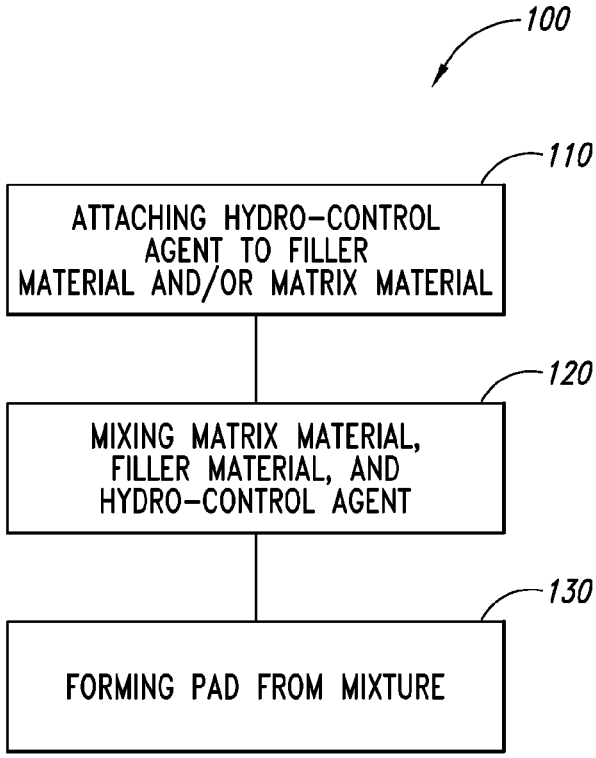
FIG. 2 is a flow chart of a method for manufacturing a CMP subpad in accordance with an embodiment of the invention.
Figure 3:
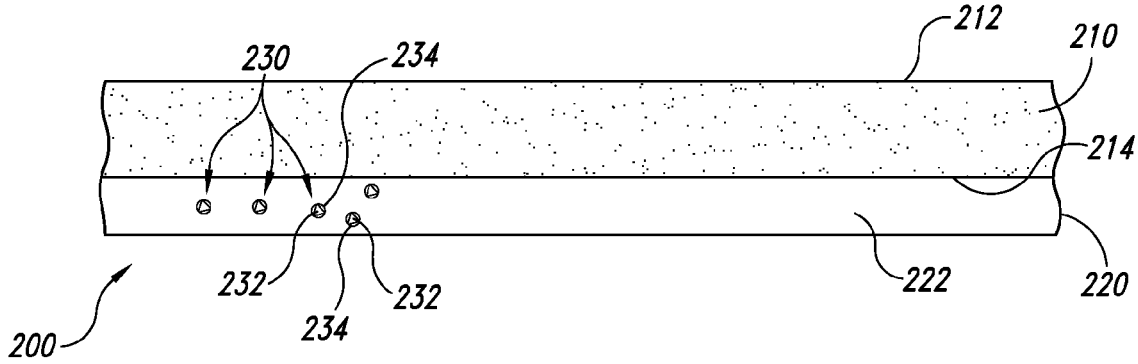
FIG. 3 is a schematic cross-sectional view of a pad assembly for use in a CMP process in accordance with an embodiment of the invention.
Figure 4:
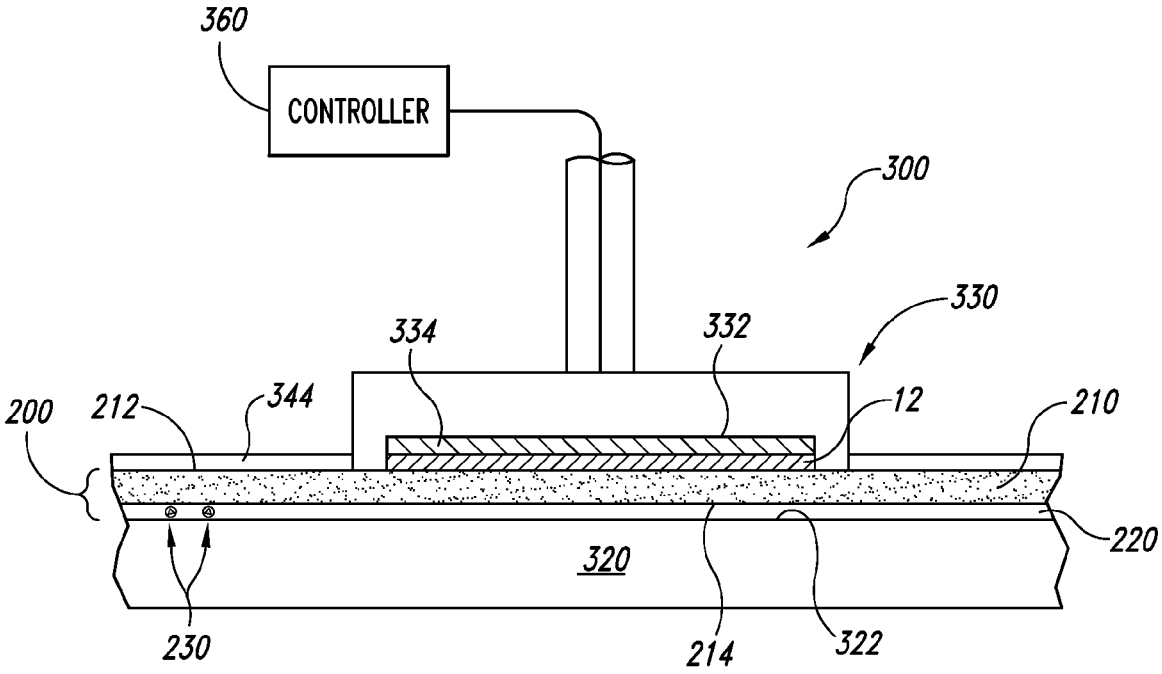
FIG. 4 is a schematic side elevation view of a portion of a CMP apparatus using a pad assembly in accordance with an embodiment of the invention.

FIGS. 2-4 illustrate several methods and apparatus for mechanically and/or chemically-mechanically removing material from microfeature workpieces in accordance with embodiments of the invention. Several specific details of the invention are set forth in the following description and in FIGS. 2-4 to provide a thorough understanding of certain embodiments of the invention. One skilled in the art, however, will understand that the present invention may have additional embodiments, or that other embodiments of the invention may be practiced without several of the specific features explained in the following description. The term "microfeature workpiece" is used throughout to include substrates upon which and/or in which microelectronic devices, micromechanical devices, data storage elements, micro-optics, and other features are fabricated. For example, microfeature workpieces can be semiconductor wafers, glass substrates, dielectric substrates, or many other types of substrates. Microfeature workpieces generally have at least several features with critical dimensions less than or equal to 1 μm, and in many applications the critical dimensions of the smaller features on microfeature workpieces are less than 0.25 μm or even less than 0.1 μm. Furthermore, the terms "planarization" and "planarizing" mean forming a planar surface, forming a smooth surface (e.g., "polishing"), or otherwise removing materials from workpieces. Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or types of other features and components are not precluded.

B. Embodiments of Methods for Manufacturing Subpads

FIG. 2 is a flow chart illustrating a method 100 for manufacturing a CMP subpad used to mechanically remove material from a microfeature workpiece in CMP processing. The method 100 includes a preparation stage 110, a mixing stage 120, and a forming stage 130. The preparation stage 110 includes attaching a hydro-control agent to a filler material and/or a matrix material. The hydro-control agent can be chemically grafted to or physically adsorbed with the filler material. In some embodiments, the hydro-control agent can be chemically anchored through graft polymerizations, such as free radicals. The mixing stage 120 includes mixing a matrix material, the filler material, and the hydro-control agent to form a pad mixture. The mixing stage 120 can be similar to mixing conventional filler materials with matrix materials known in the art of manufacturing CMP subpads. The forming stage 130 can include casting, molding, extrusion, photo-imaging, printing, sintering, coating, or other techniques. For example, the forming stage can include transferring the pad mixture to a mold and curing the pad mixture for a suitable period. The mixture is then cooled to form a molded article including the matrix material, the filler material, and the hydro-control agent. The molded article can then be "skived" into thin sheets to form a suitable subpad.

The preparation stage 110 can be performed using a number of different matrix materials, filler materials, and hydro-control agents. For example, the matrix materials can be polyurethane or other suitable polymeric materials. The filler material can include silica particles, alumina particles, other metal oxide particles, and other types of inorganic particles. In certain embodiments, the filler materials are not limited to including inorganic particles, but rather the filler material can be polymeric microballoons.

The hydro-control agents can include coupling agents and/or surfactants. For example, suitable coupling agents are silanes, such as fluoroalkyltrichlorosilane, or other compounds of silicon and hydrogen ($Si_nH_{2n+2}$). The silane coupling agents can also be N-(2-amino-ethyl)-3-aminopropyl-trimethoxysilane (Z-2020), N-(2-(vinylbenzyl-amino)-ethyl)-3-amino-propyl-trimethoxysilane (Z-6032), or 3-glycidoxy-propyl-trimethoxysilane (Z-6040).

Silane coupling agents adhere to inorganic filler materials and the polymeric material because the $Si(OR_3)$ portion reacts with the inorganic materials and the organofunctional group reacts with the polymeric materials. The silane coupling agent may be applied to the inorganic filler materials as a pretreatment before being added to the matrix material, or the coupling agent may be applied directly to the matrix material. In one embodiment, the silane coupling agent is attached to the filler material by adsorbing the coupling agent to the surface of the inorganic particles of the filler material. This process, more specifically, can include adsorbing the silane coupling agent to the inorganic particles out of a solution containing the silane coupling agent.

In alternative embodiments, the hydro-control elements can potentially be surfactants that are typically physically adsorbed to the inorganic filler materials. Typical surfactants are water-soluble, surface-active agents that include a hydrophobic portion, such as a long alkyl chain. The surfactants can be adsorbed or otherwise attached to the filler material, or the surfactants can be mixed with the polymeric matrix material.

The hydro-control agent for use in the preparation stage 110 is typically selected to increase the hydrophobicity of the filler material. As a result, when the filler material, hydro-control agent, and matrix material are mixed in the mixing stage 120, the hydrophobic nature of the hydro-control agent is at least partially imparted to the pad mixture. The individual subpads formed from the pad mixture accordingly have a higher hydrophobicity compared to subpads formed of the same matrix material and filler material without the hydro-control agent.

The following examples provide specific embodiments of the method 100 for manufacturing CMP subpads. Several aspects of these specific examples, such as mixing methods and curing times/temperatures, are well known in the art and not included herein for purposes of brevity. As such, the following examples are not to be limiting or otherwise construed as the only embodiments of the invention.

EXAMPLE 1

1) Adsorb or otherwise attach fluoroalkyltrichlorosilane molecules to silica particles.
2) Mix the silica particles and the fluoroalkyltrichlorosilane molecules with a polymeric material to form a pad mixture.
3) Optionally mold, cast or extrude the pad mixture of the polymeric material, silica particles, and fluoroalkyltrichlorosilane molecules.
4) Cure the pad mixture.
5) Optionally cut the cured pad mixture into subpads.

EXAMPLE 2

1) Adsorb or otherwise attach fluoroalkyltrichlorosilane molecules to alumina particles.
2) Mix the alumina particles and the fluoroalkyltrichlorosilane molecules with a polymeric material to form a pad mixture.
3) Optionally mold, cast or extrude the pad mixture of the polymeric material, silica particles, and fluoroalkyltrichlorosilane molecules.
4) Cure the pad mixture.
5) Optionally cut the cured pad mixture into subpads.

EXAMPLE 3

1) Mix fluoroalkyltrichlorosilane with a polymeric material.
2) Add silica particles to the mixture of fluoroalkyltrichlorosilane and polymeric material to form a pad mixture.
3) Optionally mold, cast or extrude the pad mixture.
4) Cure the pad mixture.
5) Optionally cut the pad mixture into subpads.

EXAMPLE 4

1) Mix fluoroalkyltrichlorosilane with a polymeric material.
2) Add alumina particles to the mixture of fluoroalkyltrichlorosilane and polymeric material to form a pad mixture.
3) Optionally mold, cast or extrude the pad mixture.
4) Cure the pad mixture.
5) Optionally cut the pad mixture into subpads.

C. Embodiments of Apparatus and Methods for Removing Material

FIG. 3 is a schematic cross-sectional view of a subpad 200 in accordance with one embodiment of the invention. In this embodiment, the subpad 200 includes a planarizing medium 210 (e.g., a planarizing pad) having a bearing surface 212 and a backside 214. The bearing surface 212 is configured to contact the surface of a microfeature workpiece to mechanically and/or chemically-mechanically remove material from the workpiece. The planarizing medium 210 can have grooves, raised features (e.g., truncated cones or pyramids), or other structures that promote or otherwise control the distribution of planarizing solution. Additionally, the planarizing medium 210 can include abrasive particles fixed at the bearing surface 212, or in other embodiments the planarizing medium does not include fixed-abrasive particles.

The pad assembly 200 further includes a subpad 220 attached to the backside 214 of the planarizing medium 210.

In the particular embodiment shown in FIG. 3, the subpad 220 includes a matrix 222 and an enhanced filler material 230. The matrix 222 can be a polymeric material, such as polyurethane or other suitable polymers. The enhanced filler material 230 can include a filler element 232 and a hydro-control agent 234 attached to the filler element 232. As set forth above, the filler element 232 can be an inorganic particle or another type of particle, and the hydro-control agent 234 can be a compound that increases the hydrophobicity of the matrix 222 and/or the filler element 232. The hydro-control agent can accordingly be any of the coupling agents and/or surfactants set forth above. The enhanced filler material 230 imparts a high hydrophobicity to the subpad 220 that inhibits or otherwise prevents liquids from absorbing into the matrix 222. In several embodiments, the subpad is expected to be at least substantially impermeable to liquids. As a result, the subpad 220 is expected to have consistent mechanical properties for a long period of time because the liquids in the planarizing solution are not likely to affect the size, compressability, and/or elasticity of the matrix material 222 as much as subpads without the hydro-control agent 234. The subpad 220, therefore, is expected to provide good uniformity and have a long operating life.

FIG. 4 is a schematic view of a machine 300 that uses an embodiment of the pad assembly 200 set forth above with respect to FIG. 3. The machine 300 includes a support 320, a workpiece holder or head 330, and the pad assembly 200. In the illustrated embodiment, the head 330 has a lower surface 332 in a retaining cavity and a resilient pad 334 in the retaining cavity. The microfeature workpiece 12 can be attached to the resilient pad 334 or directly to the lower surface 332 of the head 330.

The machine 300 further includes a controller 360 for operating the head 330 and/or the support 320 to rub the workpiece 12 against the bearing surface 212 of the planarizing medium 210. In operation, a planarizing solution 334 can be dispensed onto the bearing surface 212 to remove material from the workpiece 12. As explained above, the liquids from the planarizing solution 334 are inhibited from absorbing into the subpad 220 by the enhanced filler material 230.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A method of manufacturing a subpad for removing material from a microfeature workpiece, comprising:

attaching a hydro-control agent to an inorganic filler material to increase the hydrophobicity of the inorganic filler material;

mixing a matrix material with the inorganic filler material having the attached hydro-control agent to form a pad mixture; and forming the pad mixture into a subpad.

2. The method of claim 1 wherein the hydro-control agent comprises a silane coupling agent attached to the inorganic filler material.

3. The method of claim 2 wherein the silane coupling agent comprises fluoroalkyltrichlorosilane.

4. The method of claim 1 wherein the hydro-control agent comprises a surfactant.

5. The method of claim 1 wherein the matrix material comprises a polymer.

6. The method of claim 5 wherein the hydro-control agent comprises a silane coupling agent attached to the inorganic filler material.

7. The method of claim 6 wherein the silane coupling agent comprises fluoroalkyltrichlorosilane.

8. The method of claim 5 wherein the hydro-control agent comprises a surfactant.

9. The subpad of claim 1 wherein the inorganic filler material comprises a metal oxide.

10. The method of claim 9 wherein the metal oxide is silica or alumina, and wherein the hydro-control agent comprises fluoroalkyltrichlorosilane.

11. A method of manufacturing a subpad, comprising:

increasing hydrophobicity of an inorganic filler material;

forming a pad mixture with the inorganic filler material having the increased hydrophobility and a matrix material; and constructing a subpad for a chemical-mechanical polishing apparatus with the formed pad mixture.

12. The method of claim 11 wherein:

the inorganic filler material includes a metal oxide;

increasing hydrophobicity includes attaching a compound with a formula of $Si_nH_{2n+2}$, where n is a positive integer, to the metal oxide of the inorganic filler material; and constructing a subpad includes at least one of casting, molding, extruting, photo imaging, printing, sintering, and coating the pad mixture.

13. The method of claim 11 wherein increasing hydrophobicity includes attaching a silane coupling agent to the inorganic filler material.

14. The method of claim 11 wherein increasing hydrophobicity includes attaching fluoroalkyltrichlorosilane to the inorganic filler material.

15. The method of claim 11 wherein increasing hydrophobicity includes attaching a surfactant to the inorganic filler material.

16. The method of claim 11 wherein the matrix material comprises a polymer, and wherein forming a pad mixture includes mixing the matrix material having the polymer with the inorganic filler material having the increased hydrophobility.

17. A method of manufacturing a subpad, comprising:

reacting an inorganic filler material with a compound with a formula of $Si_nH_{2n+2}$, where n is a positive integer;

mixing a matrix material with the inorganic filler material reacted with the compound with a formula of $Si_nH_{2n+2}$, where n is a positive integer; and forming the pad mixture into a subpad for a chemical-mechanical polishing apparatus.

18. The method of claim 17 wherein the inorganic filler material includes at least one of silica and alumina.

19. The method of claim 17 wherein reacting an inorganic filler material includes reacting the inorganic filler material with a silane coupling agent.

20. The method of claim 17 wherein reacting an inorganic filler material includes reacting the inorganic filler material with fluoroalkyltrichlorosilane.

* * * * *

UNITED STATES PATENT AND TRADEMARK OFFICE

CERTIFICATE OF CORRECTION

PATENT NO. : 8,105,131 B2
APPLICATION NO. : 12/621366
DATED : January 31, 2012
INVENTOR(S) : Rodney C. Kistler et al.

It is certified that error appears in the above-identified patent and that said Letters Patent is hereby corrected as shown below:

IN THE CLAIMS:

In column 8, line 12, in Claim 9, delete “subpad” and insert -- method --, therefor.

In column 8, line 16, in Claim 10, delete “fiuoroalkyltrichlorosilane.” and insert -- fluoroalkyltrichlorosilane. --, therefor.

In column 8, line 20, in Claim 11, delete “hydrophobility” and insert -- hydrophobicity --, therefor.

In column 8, line 30, in Claim 12, delete “extruting,” and insert -- extruding, --, therefor.

In column 8, lines 44-45, in Claim 16, delete “hydrophobility.” and insert -- hydrophobicity. --, therefor.

Signed and Sealed this
Twenty-seventh Day of March, 2012

David J. Kappos

David J. Kappos
*Director of the United States Patent and Trademark Office*